US005513767A

United States Patent [19]

Daehn

[11] Patent Number: 5,513,767

[45] Date of Patent: May 7, 1996

[54] PRESSURIZED CONTAINER

[75] Inventor: Ralph C. Daehn, Wayne, Ill.

[73] Assignees: Materials Engineering Inc; Ray Van Thyne; Christian Kinkel, all of Virgil, Ill.

[21] Appl. No.: 176,419

[22] Filed: Jan. 3, 1994

[51] Int. Cl.[6] ..... B65D 83/14

[52] U.S. Cl. ..... 220/89.2; 220/612

[58] Field of Search ..... 220/745, 661, 220/89.2, 612, DIG. 27, 678, 612

[56] References Cited

U.S. PATENT DOCUMENTS 3,292,826 12/1966 Abplanalp ..... 220/89.2
3,404,797 10/1968 Dolling ..... 220/89.2
3,622,051 11/1971 Benson ..... 220/89.2
4,654,191 3/1987 Krieg ..... 220/89.2
4,721,224 1/1988 Kawabata ..... 220/89.2
4,744,382 5/1988 Visnic et al. ..... 220/89.2

*Primary Examiner*—Timothy F. Simone
*Assistant Examiner*—Tony G. Soohoo
*Attorney, Agent, or Firm*—Dennis H. Rainear

[57] ABSTRACT

The invention relates to an improved pressurized container, such as an aerosol can, which has crimping and welding of the top wall to the side wall, and which can withstand internal pressurization exceeding 400 psi and as high as 450 psi. The containers have continuous or interrupted reinforcing welding and also a notch or weakened area in the side wall to thereby direct the location of the controlled venting. In this manner, a safe, non-explosive venting of the container can occur.

12 Claims, 2 Drawing Sheets

PRESSURIZED CONTAINER

TECHNICAL FIELD

The invention relates to an improved pressurized, welded container design and structure able to tolerate increased working pressure and possessing a safer venting mechanism. More specifically, an improved aerosol can is provided.

BACKGROUND ART

Aerosol containers are a common and popular means for the delivery of such diverse materials as spray paint, hair spray, lubricants, and the like. The product is loaded into the container, along with the propellant. The propellant is a liquid with a high vapor pressure, which provides the pressure for discharging the product. Alternatively, compressed gas may be used as the pressurizing medium. Aerosol containers, such as cans, are commonly pressurized to approximately 70 psi at room temperature which enables the contents to be expelled in a controlled release.

Aerosol containers currently in use are metal, of a three-piece construction or a two-piece construction. The three-piece containers consist of a seamed side wall, an outwardly domed top wall, and an inwardly domed bottom wall. The top and bottom walls are fastened to the cylindrical side wall by a mechanically formed double seam, with a sealing compound incorporated into the seam. In the two-piece containers, one end and the side wall are made in one piece by a forming step.

The shift in 1979 from halogenated hydrocarbons as the propellants requires improved aerosol containers capable of withstanding increased internal pressures. This, however, increases the potential danger if the container bursts, resulting in a rocketing reaction of the container.

It is therefore desirable to have a higher pressure aerosol container vent its pressurized contents rather than violently burst. The controlled vented release of the aerosol container contents, prior to achieving a pressurization that could cause explosive rupturing of the container, will reduce or avoid the dangers due to bursting of an aerosol container.

The introduction of artificial weakness into aerosol containers has recently had limited commercial production application. U.S. Pat. Nos. 3,850,339, issued Nov. 26, 1974 to Kinkel, 4,513,874, issued Apr. 30, 1985 to Mulawski and 4,588,101, issued May 13, 1986 to Ruegg disclose devices of this nature. These weaknesses can be broadly characterized as scores in the metal that are intended to locally fracture the material when a specific pressure range is reached or a specific over pressurization event occurs, such as to outwardly buckle the dome or the bottom end. These pressure release mechanisms are highly dependent on the manufacturing processes and controlled scoring of the metal. For the weakened area to fracture at the proper pressure, the tolerances of the manufacturing process must be closely and consistently controlled.

Further, U.S. Pat. No. 3,680,743, issued Aug. 1, 1972 to Reinnagel teaches that surface scoring methods for pressure venting have not proved reliable because material thickness tolerances do not allow for accurate scored thickness control.

U.S. Pat. No. 5,249,701, issued Oct. 5, 1993 to the present inventor taught an aerosol can with a plurality of interrupted welds or bonds between the end wall and the side wall of the can, whereby the failure of the can could be directed to occur at a location between the welds or bonds. That design works well under hydraulic conditions, or for cans which are full. However, for almost-empty cans, and partially-filled cans which are placed in a fire, the venting does not release the pressure quickly enough.

Therefore, it would be desirable to have a container design in which the container can withstand internal pressurization up to about 400 psi, or more, and which can safely vent said pressure in a non-explosive manner.

BRIEF DISCLOSURE OF INVENTION

The present invention significantly improves the operating pressure range and safety of pressurized containers, such as aerosol cans, and provides a venting mechanism for controlled pressure release.

The invention relates to the combined use of welding the end seams, and scoring or weakening of the container side wall. The welding serves to reinforce the container walls and control the location in the wall at which the deformation and eventual failure occurs. The side wall failure or controlled venting will then initiate at one or more of the scores or locally weakened locations. The combination of these features is unique and the results of the combination are surprising and unexpected from the prior art.

According to the present invention, the means for controlling the location in the wall at which the deformation starts includes a weld for localizing the weakening of resistance of the wall to outward deformation from the internal pressure of the container. The degree of weakening can be selected to control the internal pressure at which deformation will start. In this form of the invention, the welds or reinforcing means for controlling the location in the side wall at which the deformation starts also control the direction in which the outward deformation progresses so that its progress is in the direction toward the weakened score(s) or notch(es). The continuous or interrupted weld itself is very strong and resists deformation so that it acts as a lever to transfer stress to the notch or notches.

In one embodiment, the present invention is directed to an improved tubular pressurized container comprising a top wall, a side wall tube, and a bottom wall, wherein the top wall and the bottom wall are welded to the side wall tube, and wherein the tube further comprises at least one notch which partially penetrates the tube side wall. The notch can be a plurality of notches, also called partial cuts or scoring, appearing at several locations around the perimeter of the container.

In another embodiment, the notch in the tubular side wall is located just below the top weld or welds between the top wall and the side wall.

In still another embodiment, the pressurized container comprises a one piece bottom which forms both the side wall tubular body and the bottom wall to which is welded a top wall.

In another embodiment, the notch in the tubular side wall is located just above the bottom weld or welds between the bottom wall and the side wall.

It is not intended that the invention be limited to the specific terms so selected and it is to be understood that each specific term includes all technical equivalents which operate in a similar manner to accomplish a similar purpose. Thus, "container" herein is meant to include tanks, vessels, canisters, cartridges, cans, such as aerosol spray cans, and the like capable of withstanding internal pressurization. Also included are stationary and mobile pressurized tank cars, rail cars, pressurized spray containers, and the like.

BRIEF DESCRIPTION OF DRAWINGS

In describing the preferred embodiment of the invention which is illustrated in the drawings, specific terminology will be resorted to for the sake of clarity.

DETAILED DESCRIPTION

One object of the present invention is to increase the working pressure of an aerosol can from the current maximum of about 270 psi (DOT 2Q) to about 400 psi or above.

Another object of the present invention is to provide a venting mechanism for the controlled pressure release of pressurized containers such as aerosol cans. Welded end seams for aerosol cans are novel, and the present invention combines welded end seams and crimping to provide significantly increased strength against internal pressurization.

Figure 1:
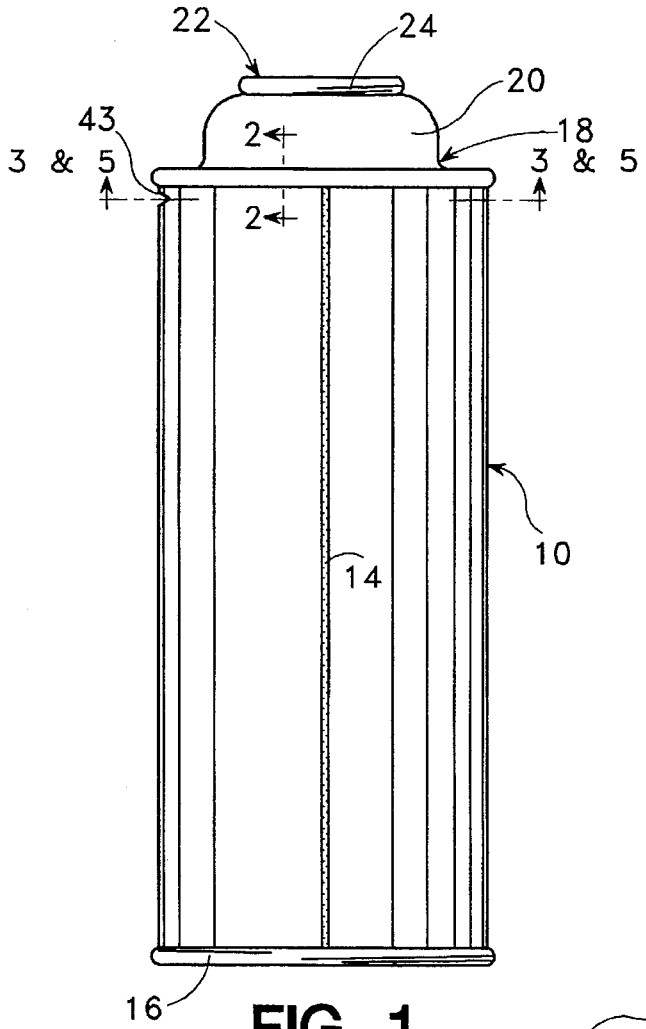
FIG. 1 is a side elevational view of an aerosol container incorporating the features of the present invention.

Referring now to the drawings and more particularly to FIG. 1 thereof, there is illustrated an aerosol container 10 incorporating the features of the present invention. Container 10 comprises a sheet-metal, tubular side wall bent in the form of a cylinder and welded along line 14. An end or bottom wall 16 is welded to side wall 12 at one end thereof, and an end or top wall 18 is welded to side wall 12 at the other end thereof. In another form of the invention, side wall 12 and bottom wall 16 are formed from a single piece of sheet metal and there is no weld 14 at the bottom. In the embodiment depicted, top wall 18 has a dome 20 ending in an orifice 22 (FIG. 3) defined by a top curl 24. Side wall 12 is bent over to form cylindrical flange 32. Side wall 12 has an inner surface 42.

The top wall 18 may be attached to the upper end of side wall 12 utilizing conventional sealing compound 51 and seam construction techniques. Top wall 18 is bent to form a cylindrical flange 34, in turn bent back on itself to provide a cylindrical flange 36 which is in turn bent on itself to form cylindrical flange 38. Included, for example, in the acceptable seam techniques are the construction techniques taught in applicant's U.S. Pat. No. 5,249,701, which teachings are incorporated herein by reference.

Figure 2:
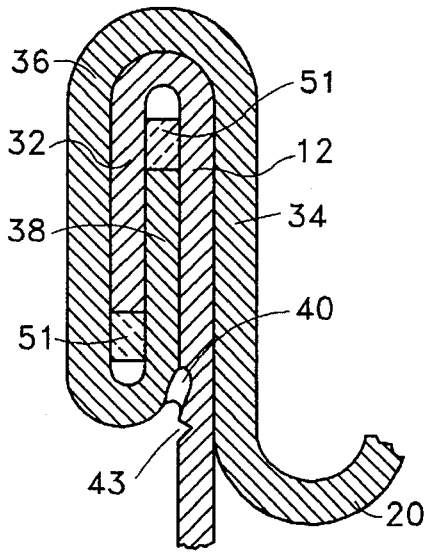
FIG. 2 is an enlarged view in horizontal section taken along the line 2—2 of FIG. 1.
Figure 3:
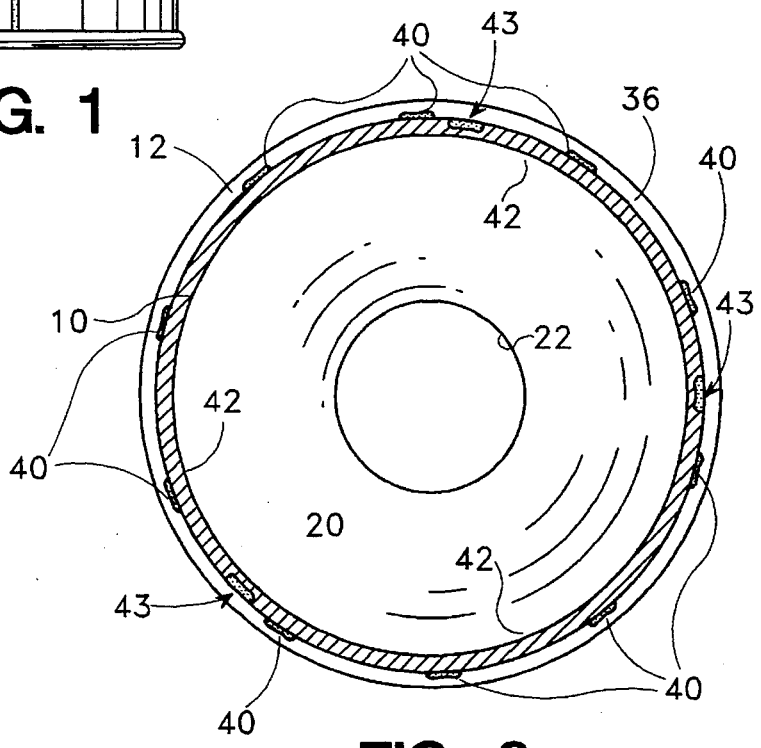
FIG. 3 is an enlarged view in horizontal section taken along the line 3—3 of FIG. 1 showing separated notches and separated welds.
Figure 5:
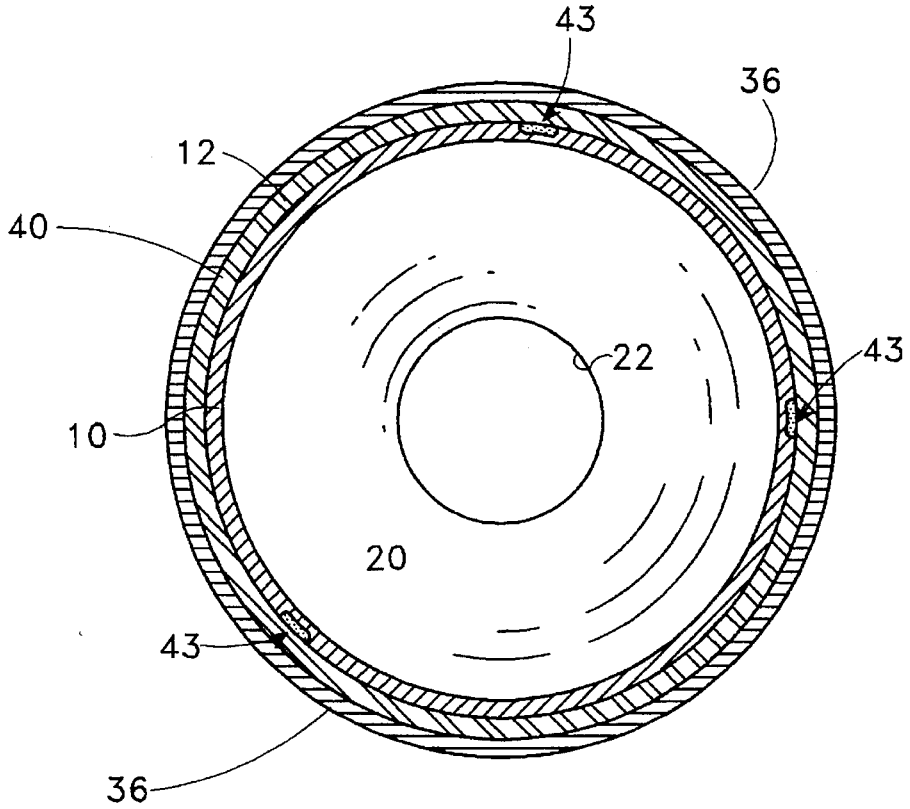
FIG. 5 is an enlarged view in horizontal section taken along the line 3—3 of FIG. 1 showing separated notches and a continuous circumferential weld.

The attachment of top wall 18 to side wall 12 is, in one embodiment, through continuous or interrupted reinforcing and adhesive bonds or welds 40 preferably created by laser, as best seen in FIG. 2. Interspaced between the reinforcing interrupted welds 40 or altrnatively immediately beneath a continuous weld 40 is placed at least one notch, safety vent or scoring 43. These notches 43 can be created by a means selected from mechanical or thermal methods, such as lasers or a punch and die. FIG. 3 illustrates a can with discontinuous welds 40 and discontinuous notches 43. FIG. 5 illustrates a can with continuous and circumferential weld 40 and discontinous notches 43 shown at the horizontal view of line 3—3 in FIG. 1. FIGS. 3 and 5 are not necessarily drawn to scale with regard to wall thickness to can diameter ratio since the side wall thickness is illustrated somewhat thicker to better show the notches. Cutting or machining away of metal at the notch or score is the preferred means for creating the notch or notches 43. The notches 43 preferably do not penetrate into the side wall 12 more than about 75% of the wall thickness so as to avoid premature failure of the pressurized container. The preferred notch depth is from about 50% to about 75% of the wall thickness, or about 0.004 to 0.006 inches. Prior art attempts at scoring of the can body were directed to weakening the end walls of the container rather than the side wall as in the present invention. These prior art attempts at scoring of the can were unsuccessful because the ends would often release from the can body creating a projectile, in the case of an "almost empty" can. In order to vent before this would occur, fairly deep scoring was necessary. By the present invention, however, the high pressure venting is less sensitive to the score or notch depth and the welded ends remain attached.

In another embodiment of the present invention, the notch 43 is placed adjacent the welds utilized to bond the bottom wall 16 to the adjacent end of the side wall 12, whereby the notch can be spaced adjacent the continuous or interrupted welds 40 at the seam between the bottom wall 16 and the side wall 12. A continuous weld can be used in addition to the interrupted weld 40. Or, both ends can employ an interrupted welding construction with interspaced notches like the construction shown in FIG. 3.

Figure 4:
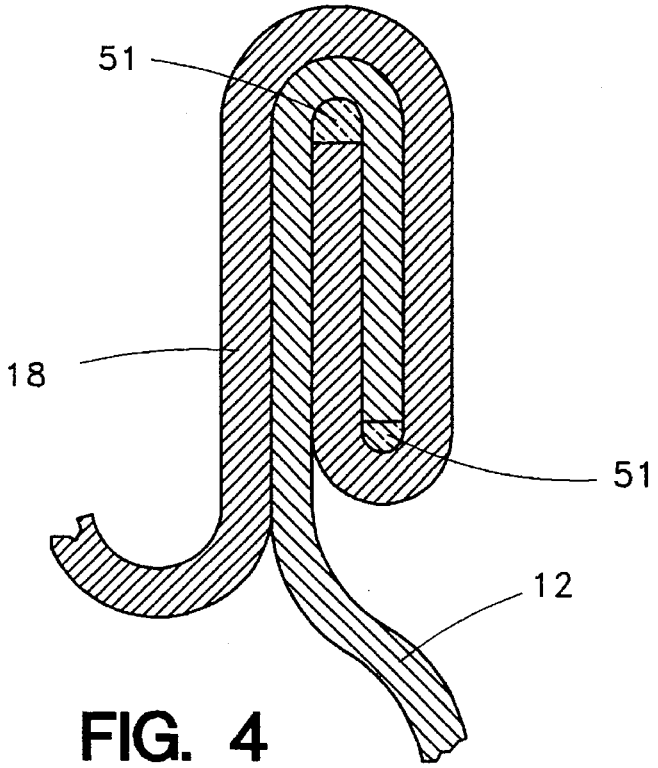
FIG. 4 is a side view of the crimping prior to welding of a seam in the present invention.

FIG. 4 illustrates the crimping before the welding and notching of a necked-in can in the present invention, however, the notching can also be done while the side wall 12 is still in sheet form before forming the tubular body 10. Top wall 18 can have a thickness of, for example, 0.015 inches and is given two 180 degree bends, thereby interlocking top wall 18 with side wall 12. Side wall 12 can be, for example, 0.008 inches in thickness, and can be necked down to produce a narrower diameter of the container to reduce the expense of the top wall 18. Also included in FIG. 4 is the sealing compound 51.

Thus, in one embodiment of the present invention, a top wall 18 is folded over or crimped onto the top lip of the folded edge of the side wall 12, with a sealing compound 51 contained in the void at the end of the folds as shown in FIG. 4. The necking or narrowing of the side wall can be at, for example, a 30° angle. A laser beam generated by a $CO_2$ laser or a YAG laser is then directed along a similar angle into the juncture formed between the top wall 18 and the necked-down side wall 12, to induce a laser weld at said juncture. The laser beam in one embodiment is about 0.010 inches in diameter and is applied for a period of time and at an energy level sufficient to weld the top wall 18 to the side wall 12.

It is to be understood that the present invention is not to be limited to any special type of welding so long as it is of a character which will properly unite the parts to be employed and provide adequate spacing of the interrupted welds. Laser welding is the preferred welding technique herein.

Thus, the present invention is directed to a welded pressurized container comprising a tubular side wall, a top end wall attached to a first end of the tubular side wall, a bottom end wall attached to a second end of the tubular side wall, at least one reinforcing weld between the tubular side wall and at least one of the end walls, and further comprising at least one notch in the side wall, whereby the container can sustain an internal pressure of at least 400 psi, and wherein when the internal pressure is increased sufficiently, the side wall of the container will fail in a non-explosive manner. By "non-explosive" failure herein is meant the controlled and non-projectile venting of excessive pressure built up within the container due to, for example, exposure to heat. Pressure within the container above a predetermined level will initiate non-explosive failure or rupture at one or more of the notches or scores. Such "non-explosive" failure of the container of the present invention occurs in a gradual hissing-type release of pressure and contents without the creation of flying projectiles, particles of container, or "rocketing" of the ruptured container.

Standard aerosol cans in the past burst at about 220 to 280 psi. With the present invention, the failure of the can did not occur until about 450 psi. Further, the failure mode was not the more dangerous bursting but rather is the preferred venting. Lastly, the buckling of the ends prior to venting serves as a visual warning that the internal pressure has reached a high level.

Thus, the present invention involves a higher pressure aerosol container design construction and a venting mechanism for the controlled pressure release of aerosol containers. In this manner, the venting mechanism and container design of the present invention provide a significantly safer aerosol container than is previously available. When the containers of the present invention become pressurized, the containers will buckle at relatively low pressures but will not blow off the end piece because the containers of the present invention are not notched on the bottom. Prior an pressurized containers vent when an end buckles, with typical buckling pressures being 140 to 230 psi, depending on the D.O.T. pressure rating, i.e., standard, 140 psi minimum; 2P, 160 psi minimum; 2Q, 180 psi minimum. However, the pressurized containers of the present invention do not vent when an end buckles because the ends are not scored or weakened as are the ends in the prior art. The ends cannot detach from the bodies because the ends are welded on. Therefore, the aerosol cans of this invention will not "rocket" but instead contain a weakened zone measuring about ⅜ of an inch to about ½ of an inch in width at a position located adjacent and immediately beneath the weld between the top end and the side wall. Within this notch or weakened zone, the metal of the side wall is thinned to about 0.002 to 0.004 inches from the original thickness of about 0.008 inches. As the pressure within the can is increased and approaches the bursting pressure, the metal in the base of the notch or weakened zone is ruptured by the tensile stresses acting upon it and the pressure is relieved gradually. Thus, the side wall vents at tile location of the notch when the internal pressure in the container reaches a pressure limit predetermined by the remaining thickness of side wall metal beneath the surface of the notch.

Without the desired venting of the side wall at the location of the notch, the body of the pressurized container would split longitudinally from the hoop stresses imposed by the internal pressure. A longitudinal split from hoop stresses is a sudden event, generating flying fragments. Hoop stresses in a pressurized cylinder are twice as great as the longitudinal stresses, which is why the body side wall must be thinned to induce rupture at the desired location adjacent the welds.

Example of Conventional Aerosol Can

Comparison testing was performed on 2500 cans made commercially as DOT 2Q cans. These cans were made from 0.015 inch thich steel top ends, seamed, (also known in the industry as double-seamed), onto 0.008 thick side wall bodies. The can bodies were made by rolling flat steel sheet into cylinders 2.500 inches in diameter and welding the overlapped longitudinal seam. The open ends of the cylinders were "necked in" to about 2.312 inches on the top and 2.404 inches on the botttom, then ranged to receive the end pieces. The bottom ends were also made from 0.015 inch thick steel. These cans are known in the industry as "211 by 413 necked-in" cans. The "211" stands for diameter over the seams, if not necked in, in inches and 16ths of an inch, or $2\frac{11}{16}$ inch diameter. The "413" refers to the height in inches over the seams, nominally $4\frac{13}{16}$ inches. The internal volume is 14.0 fluid ounces, brim-full.

If pressurized hydraulically, the dome typically buckles at a pressure ranging from 210 to 230 psi. Further increasing the internal pressure causes the bottom end to buckle at a pressure range of 320 to 340 psi. Bursting of an end from the can body occurs at the 320 to 340 psi range, with an equal probability of bursting at either end. The bursting is the result of the seamed hook of the body straightening out, allowing the end to separate from the body.

Hydrostatic testing usually results in non-catastrophic failures, as the liquid water, being relatively incompressible, stores little potential energy. If the same cans are tested pneumatically, the dome buckles at the same pressure range, 210 to 230 psi, but the bursting always occurs at the top end seam. Bursting pressures are in the 300 to 320 psi range, which is lower than the bursting range if the cans had been tested hydrostatically because the impact of the pneumatic dome buckling on the top seam weakens it by deforming the seam hooks.

Inventive Cans

Welding the end pieces to the can body tubular side wall suppresses bursting at the end seams. The body splits longitudinally when the hoop stresses reach the tensile strength of the body metal. With the cans described hereinabove, 0.008 inch thick body metal, with a tensile strength of 80,000 psi, will split at a presure of 500 to 550 psi. If pressurized hydrostatically, the splitting is very benign, generating a split about 4 inch long by ¼ inch wide at the widest point. If the can is pressurized pneumatically, however, the split will run, causing the can to fragment with fragments reaching high velocities.

Instead, by the present invention, venting or gradual rather than catastrophic release of the internal pressure is provided. Using a 0.004 inch deep by 0.018 inch wide by 0.500 inch long notch positioned 0.040 inch below the top seam weld, venting occurred at pressures up to 550 psi. Optimization of the notch dimensions results in venting in the 400 to 450 psi range.

The cans of the present invention, possessing welded end seams, cannot burst in the same way a normal seamed can will burst when over-pressurized. Therefore, it is not necessary according to the present invention to use body or bottom end thicknesses as great as for normal seamed cans. The present invention allows greater conservation of material by thinner body and bottom pieces, which is a significant value to can manufacturers, since most of the cost of the can is in the metal used.

The pressurized containers of the present invention are the only articles known which possess welds between the end or ends and the side wall after crimping, also known as double-seaming. By this configuration, the articles of the present invention can exhibit internal pressurizations in excess of 400 psi, and as high as 450 psi, without the potential for catastrophic or explosive failure.

While certain preferred embodiments of the present invention have been disclosed in detail, it is to be understood that various modifications may be adopted without departing from the spirit of the invention or scope of the following claims.

That which is claimed is:

1. A welded container comprising a tubular side wall, a top end wall attached to a first end of the tubular side wall, a bottom end wall attached to a second end of the tubular side wall, at least one reinforcing weld between the tubular side wall and at least one of the end walls, and further comprising at least one notch in the side wall adjacent said weld, whereby the container can sustain an internal pressure of at least 400 psi, and wherein when the internal pressure is increased sufficiently, the side wall of the container will vent at the notch in a non-explosive manner.

2. The welded container of claim 1 wherein the container has been internally pressurized to an internal pressure of up to about 450 psi.

3. The welded container of claim 1 wherein at least one weld comprises a plurality of reinforcing welds at a welded seam between the side wall and the top end wall.

4. The welded container of claim 1 wherein at least one weld comprises a plurality of reinforcing welds at a welded seam between the side wall and the bottom end wall.

5. The welded container of claim 1 wherein at least one weld is a laser weld.

6. The welded container of claim 1 wherein the notch in the side wall is adjacent the weld between one end wall and the side wall.

7. The welded container of claim 1 wherein the notch in the side wall is to a depth of from 0.004 to 0.006 inches.

8. The welded container of claim 1 wherein the side wall vents at the location of the notch when tile internal pressure in tile container is above 400 psi.

9. The welded container of claim 1 wherein the weld is continuous around the perimeter of the side wall.

10. The welded container of claim 1 wherein the side wall vents at the location of the notch when the internal pressure in the container reaches 450 psi.

11. The welded container of claim 1 wherein the side wall vents at the location of the notch when the internal pressure in the container reaches a pressure limit predetermined by the remaining thickness of side wall metal beneath the surface of the notch.

12. In an aerosol container comprising a tubular side wall, a top end wall attached to a first end of the tubular side wall, a bottom end wall attached to a second end of the tubular side wall, at least one reinforcing weld between the tubular side wall and at least one of the end walls, the improvement comprising (a) at least one notch in the side wall, wherein said notch is adjacent said reinforcing weld and wherein the side wall at the location of the notch is reduced to a thickness of from about 0.002 to 0.004 inches thick, and (b) the container is pressurized to an internal pressure of at least 400 psi, and (c) the ability to vent non-explosively at said notch when the internal pressure is increased.

* * * * *